US005564199A

United States Patent [19]

Yamamoto et al.

[11] Patent Number: 5,564,199

[45] Date of Patent: Oct. 15, 1996

[54] METHOD AND APPARATUS FOR DRYING WOOD PLATES USING HOT PLATES

[75] Inventors: Koichi Yamamoto, Tokushima; Hisayuki Nagamine, Itano-gun, both of Japan

[73] Assignee: Yamamoto Engineering Works Co., Ltd., Komatsushima, Japan

[21] Appl. No.: 353,325

[22] Filed: Dec. 5, 1994

[30] Foreign Application Priority Data

Dec. 8, 1993 [JP] Japan ..... 5-340811

[51] Int. Cl.[6] ..... F26B 5/14; B30B 15/34

[52] U.S. Cl. ..... 34/398; 34/144; 34/550; 100/38; 100/93 P; 100/196

[58] Field of Search ..... 34/397, 398, 519, 34/143, 149, 550, 545, 535; 100/38, 93 P, 196, 199

[56] References Cited

U.S. PATENT DOCUMENTS

| | | | |
|---|---|---|---|
| 2,094,862 | 10/1937 | Welch | 34/144 X |
| 3,118,742 | 1/1964 | Dalgleish et al. | 34/143 X |
| 3,318,014 | 5/1967 | Whitlon | 34/144 X |
| 3,731,520 | 5/1973 | Hickman et al. | 34/550 X |
| 3,799,366 | 3/1974 | Omelchuk | 100/196 X |
| 3,977,535 | 8/1976 | Husges et al. | 100/53 P X |
| 4,242,023 | 12/1980 | Mohrsen | 100/196 X |
| 4,811,496 | 3/1989 | Honda et al. | 34/144 |
| 5,327,824 | 7/1994 | Wild | 100/199 |

FOREIGN PATENT DOCUMENTS

| | | |
|---|---|---|
| 62-202988 | 9/1987 | Japan . |
| 62-299689 | 12/1987 | Japan . |

*Primary Examiner*—Hoang Nguyen
*Attorney, Agent, or Firm*—Wenderoth, Lind & Ponack

[57] ABSTRACT

Wood plates are dried by inserting the wood plates into respective spaces between a plurality of hot plates layered in steps. The wood plates are held, pressed and heat dried by and between the hot plates. A portion of spaces between the hot plates can be opened, and dried wood plates can be discharged from the opened spaces between the hot plates and undried wood plates can be inserted into such opened spaces. Those hot plates from which wood plates are not discharged or between which wood plates are not inserted are kept in a pressed state.

20 Claims, 6 Drawing Sheets

METHOD AND APPARATUS FOR DRYING WOOD PLATES USING HOT PLATES

BACKGROUND OF THE INVENTION

The present invention relates to a method for drying wood plates or panels using hot plates for holding the wood plates therebetween, and an apparatus for carrying out this method. Wood plates dried by the method and apparatus according to the present invention are mainly veneers used for making plywood. However, wood plates intended herein are not limited to veneers, because any other type of wood plates that can be dried while being held between hot plates also can be dried by the method and apparatus according to the present invention.

A hot blow drying method is widely used for drying wood plates obtained by slicing or cutting lumber. Such hot blow drying method includes transferring veneers by a conveyor and drying the same with hot blow, i.e. hot blown air or other gas. This method has such a drawback that veneers dried by this method are warped significantly. Consequently, this method cannot be used for drying veneers which are susceptible to being warped. A method for drying veneers held between respective hot plates does not have such drawback. Recently, raw woods such as lauan have become difficult to obtain. As a result, small diametered lumber of low cost that is susceptible to being warped after being processed to wood plate and dried and that therefore hardly has been used in the past, now is required to be dried at low cost. Under such circumstances, a method for drying wood plates using hot plates has attracted more attention than has a method for drying wood plates with hot blow.

A method for drying wood plates by using hot plates for holding the respective wood plates therebetween has the following advantages in comparison with a method for drying wood plates with hot blow:

1. Little heat energy is necessary.
2. Deformed wood can be ironed and made into a flat plate through drying, and therefore miscellaneous trees can be processed into veneers used for making plywood.
3. All of a wood plate can be dried uniformly.
4. Rough peeled wood surfaces can be altered.
5. The area contraction ratio or amount during drying can be reduced.
6. Suspension of operation due to accidental fires can be reduced.

This method has the above mentioned advantages since the entire surface of each wood plate is pressed and heat-dried by hot plates.

On the other hand, according to a method for drying lumber with hot blow, moisture is removed by evaporation from a lumber I as shown in FIG. 1. At this time, the percentage of moisture content of the lumber and the temperature change are shown in FIG. 2. In FIG. 2, the region A indicates lumber preheating, which means the preliminary time required for raising the temperature of the lumber to the wet-bulb temperature of the hot blow. The region B indicates constant rate drying during which all of the heat supplied by the hot blow is used for evaporating moisture of the lumber while maintaining constant the temperature of the lumber as long as moisture exists in the surface portion of the lumber. During such constant rate drying the water content of the lumber decreases in proportion to time. The region C indicates decreasing or falling rate drying during which the movement of the moisture from the inside of the lumber to the surface cannot catch up with or match the evaporation of the moisture from the surface. Thus, the surface portion of the lumber is dried and the temperature of the lumber surface is raised. The movement of the moisture is delayed and therefore the drying rate becomes low, i.e. it is falling.

According to such a hot blow drying method comprising the above mentioned steps practically employed at present in plywood factories, it is regarded that 1500 kg of steam is required for drying 1 $m^3$ of lumber, and 2.5 kg to 3 kg of steam is required for drying 1 kg of moisture. On the other hand, according to a method for drying wood plates using hot plates, only about 800 kg of steam is required for drying 1 $m^3$ of lumber and only less than 2 kg of steam is required for removing 1 kg of moisture. Thus, the necessary quantity of steam can be remarkably decreased. Further, according to a hot blow drying method, the necessary electric power for the drying operation is about 70 $kw/m^3$. On the other hand, according to a method for drying wood plates using hot plates, the necessary electric power for the drying operation is as low as about 24 $kw/m^3$.

A method for drying wood plates using hot plates having the above mentioned advantages is disclosed in Japanese Non-examined Patent Publications No. 202988 issued Sep. 7, 1987 and No. 299689 issued Dec. 26, 1987. Such methods include the following steps.

1. Hot plates arranged in multistep manner are opened, and wood plates are fed into the spaces between respective pairs of adjacent hot plates.
2. Then, the hot plates are closed to press the wood plates therebetween. This condition is maintained for a predetermined time, and thereby the wood plates in the pressed condition are heat-dried by the hot plates.
3. When drying of the wood plates is completed, all the hot plates are opened. Then the dried wood plates are discharged, and new undried wood plates are fed into the respective spaces between the hot plates.

As above mentioned, according to this method, wood plates are fed into and discharged from all the spaces between the respective pairs of opened hot plates. Therefore, an apparatus for carrying out this method requires a loader which is a multistep type feeding means for feeding a plurality of wood plates into the spaces between the respective opened hot plates at the same time, and an unloader which is a multistep type discharging means for discharging the plurality 6f dried wood plates at the same time. The loader and the unloader are disposed on opposite sides of the apparatus. The loader feeds wood plates into the spaces between the opened hot plates from one side of the apparatus, and the unloader discharges the dried wood plates to the other side. As a result, the entire apparatus is fairly large-sized. Further, each of such loader and unloader is of a complicated and expensive structure. Therefore, the drying line is substantially expensive. Further, since the loader and the unloader feeds or discharges a number of wood plates at the same time, it is very difficult to transfer all of the wood plates to correct positions. If only one wood plate is not correctly transferred during a transfer operation, the entire apparatus must be stopped. Further, since a number of wood plates are fed to a number of positions, if the wood plates are jammed, substantial time is required to correct the positions thereof.

Further, neither the conventional apparatus for drying wood plates using hot plates nor the conventional hot blow drying apparatus for wood plates can dry each of a plurality of wood plates to the same percentage of moisture content. This is because all of the wood plates are dried under the same conditions. When wood plates of high moisture content and of low moisture content are dried at the same time, the moisture content of all the wood plates decreases. However, the wood plates of high moisture content will still have a relatively high moisture content when the wood plates of low moisture content are dried sufficiently to have a desired low moisture content. When dried wood plates still have an excessively high moisture content they must be dried again. However, almost all plates that are dried twice are over dried. When veneers of different moisture contents are adhered together to make a plywood, the obtained plywood tends to warp. When veneers of different moisture content are adhered together, all the veneers gradually come to have the average moisture content rate. During this stage, the veneers of different moisture content contract at different respective contraction rates, and consequently the plywood warps. If wood plates transferred to the drying apparatus are made to have the same moisture content, then the dried wood plates will have the same moisture content. However, it is impossible to ensure that all wood plates before being transferred will have the same moisture content. For example, the moisture contents of veneers used for making plywoods vary from 70% to 300%. Further, if veneers are obtained from the same wood material source, one veneer obtained from a central part of the wood material source and another veneer obtained from a circumferential part thereof will have different moisture contents.

Furthermore, the conventional apparatus for drying wood plates using hot plates and the conventional hot blow drying apparatus cannot dry wood plates of different thicknesses at the same time. Since they are dried under the same conditions, the thin wood plates are over dried and the thick wood plates are dried insufficiently. Consequently, it is necessary to change the drying conditions according to the thickness of the wood plate to be dried. However, in order to change drying conditions according to the thickness of the wood plate to be dried, much time and labor are required. In such case, wood plates cannot be successively dried, which causes lowering of operation efficiency. Therefore, when wood plates of various thicknesses are dried, the operation efficiency of the apparatus as a whole is lowered remarkably.

The present invention has been developed in order to eliminate these drawbacks of the conventional method and apparatus.

An important object of the present invention is to provide a method for drying wood plates using hot plates, which method can efficiently dry a number of wood plates at low cost.

Another important object of the present Invention is to provide a compact and inexpensive apparatus for drying wood plates using hot plates, which apparatus can dry wood plates of different moisture contents, thicknesses and the like, so as to have the same moisture content when dried.

SUMMARY OF THE INVENTION

A method for drying wood plates using hot plates according to the present invention is an improvement of a method for drying wood plates comprising inserting the wood plates between respective pairs of hot plates layered in a multistep manner, and pressing and heating the wood plates by the hot plates.

According to the present invention, wood plates are kept in the pressed state by the hot plates. A part of the spaces between the hot plates are opened and wood plates are discharged from and inserted between the opened hot plates. Hot plates which are not opened are maintained pressing condition with wood plates therebetween. Only part of the hot plates are opened at a time.

Wood plates are discharged from and inserted between some hot plates, while other wood plates are maintained pressed and heat dried. While a part of the hot plates are opened, unopened hot plates hold wood plates therebetween while pressing the surfaces thereof. After wood plates are discharged from and inserted between the opened hot plates, such hot plates are closed. The hot plates layered in multistep manner are opened in order and a wood plate pressed for a predetermined time and dried is discharged therefrom, and a new undried wood plate is inserted between the opened hot plates. Then, the hot plates are closed to press the wood plate therebetween.

According to the present invention, a wood plate is discharged from opened hot plates and another wood plate is inserted therebetween, with other wood plates between unopened hot plates being maintained pressed and heat dried. A dried wood plate is discharged and an undried one is inserted between the opened hot plates, with drying of the other wood plates being maintained. Therefore, wood plates can be dried efficiently. Further, it is not necessary to transfer a number of wood plates together, and the wood plates can be simply and easily inserted and discharged.

The present invention, wherein a dried wood plate is discharged from hot plates and then an undried wood plate is inserted between the hot plates, with the other wood plates being heated and pressed between unopened hot plates, is in contrast to the conventional method for drying wood plates using hot plates, wherein all of the hot plates are opened and a number of wood plates are inserted between the hot plates at the same time.

According to the present invention, a wood plate is discharged from a pair of hot plates and a new undried wood plate is inserted therebetween, and this operation is repeated in order to insert wood plates to be dried between all of the hot plates. Therefore, an apparatus for carrying out this method, unlike the conventional apparatus, requires neither a loader nor an unloader for inserting or discharging a number of wood plates at the same time. Consequently, according to the present invention, the overall cost of an entire drying plate can be remarkably lowered and the space required for the drying plant can be reduced. Besides, since a loader and an unloader are not required, the amount of energy required can be remarkably reduced to make the drying plant more energy efficient.

Further, according to the present invention, since a dried wood plate is discharged and an undried wood plate is inserted with the other wood plates being dried, a plurality of wood plates can be dried efficiently. Further, since it is not necessary to transfer a number of wood plates at the same time, wood plates are simply and easily inserted between and discharged from the hot plates, and accidents of the type that would cause the plant to stop can be reduced.

Further, according to the present invention, wood plates having different moisture contents, thickness and the like before drying can be dried to have a uniform moisture content. This is because, according to the present invention, a pair of the hot plates are opened, so that a specified wood plate is discharged from the opened hot plates and an undried wood plate is inserted therebetween, and an optimum drying time for the undried wood plate inserted between the hot plates is calculated form data of the wood plate, so that the wood plate is dried by the hot plates for the calculated time and then is discharged. If all of the wood plates inserted between the hot plates of an apparatus are discharged at the same time and wood plates are inserted between all of the hot plates at the same time, similarly to the case of the conventional apparatus, the drying time cannot be changed for each individual wood plate. Further, according to the present invention, data of each wood plate inserted between the hot plates is input into a control means and an optimum drying time is calculated. As a result, if wood plates to be dried have different conditions before drying, each of them is dried for its optimum drying time, and after drying all of the wood plates can have a uniform moisture content.

Embodiments of the present invention now will be described in the following reference to the appended drawings. However, these embodiments show examples of a method for drying wood plates using hot plates realizing the art and idea of the present invention, and the present invention is not limited to such embodiments.

DETAILED DESCRIPTION OF THE INVENTION

Figure 1:
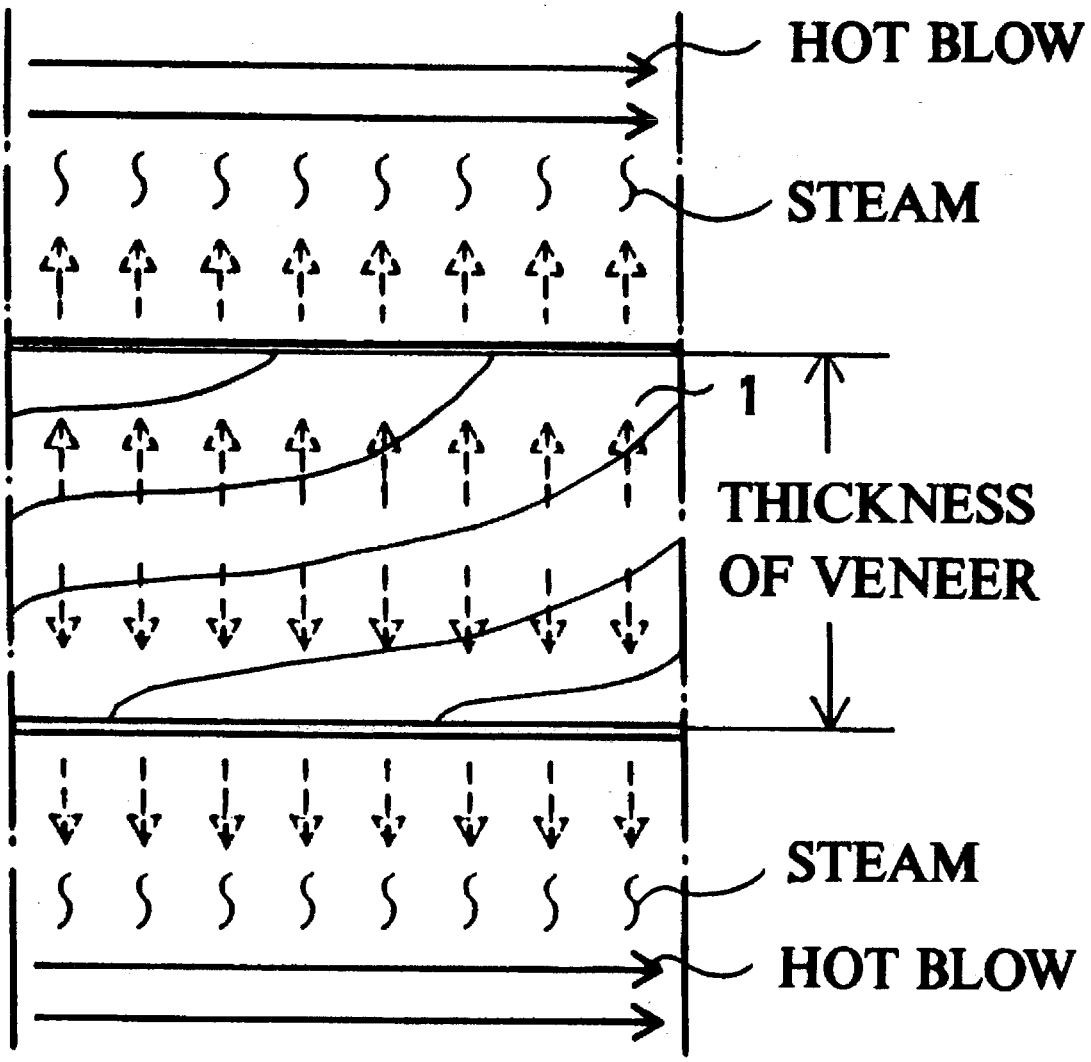
FIG. 1 is a sectional view illustrating a wood plate being dried with hot blow.
Figure 2:
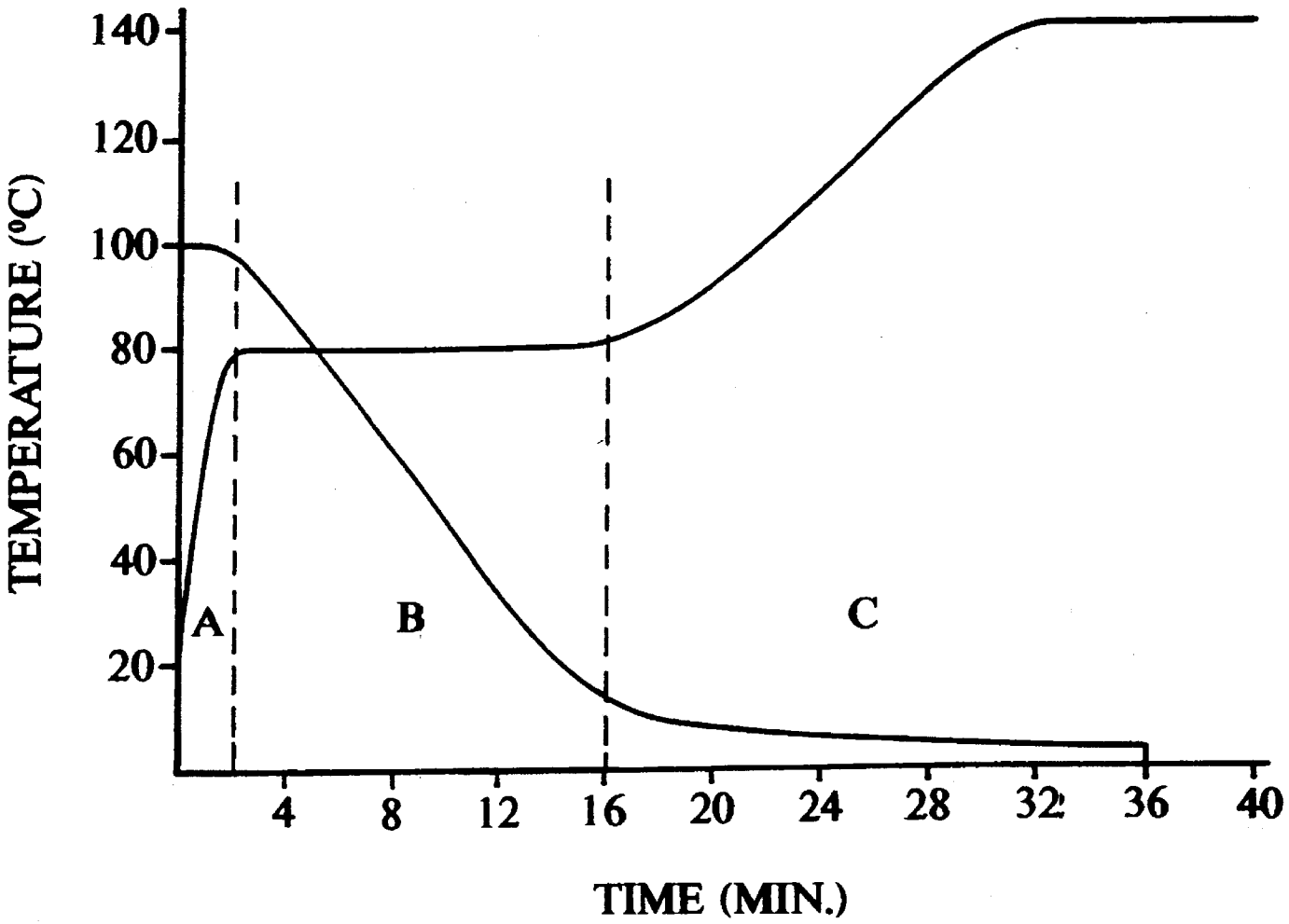
FIG. 2 is a graph showing change of temperature and moisture content when a wood plate is dried with hot blow.
Figure 3:
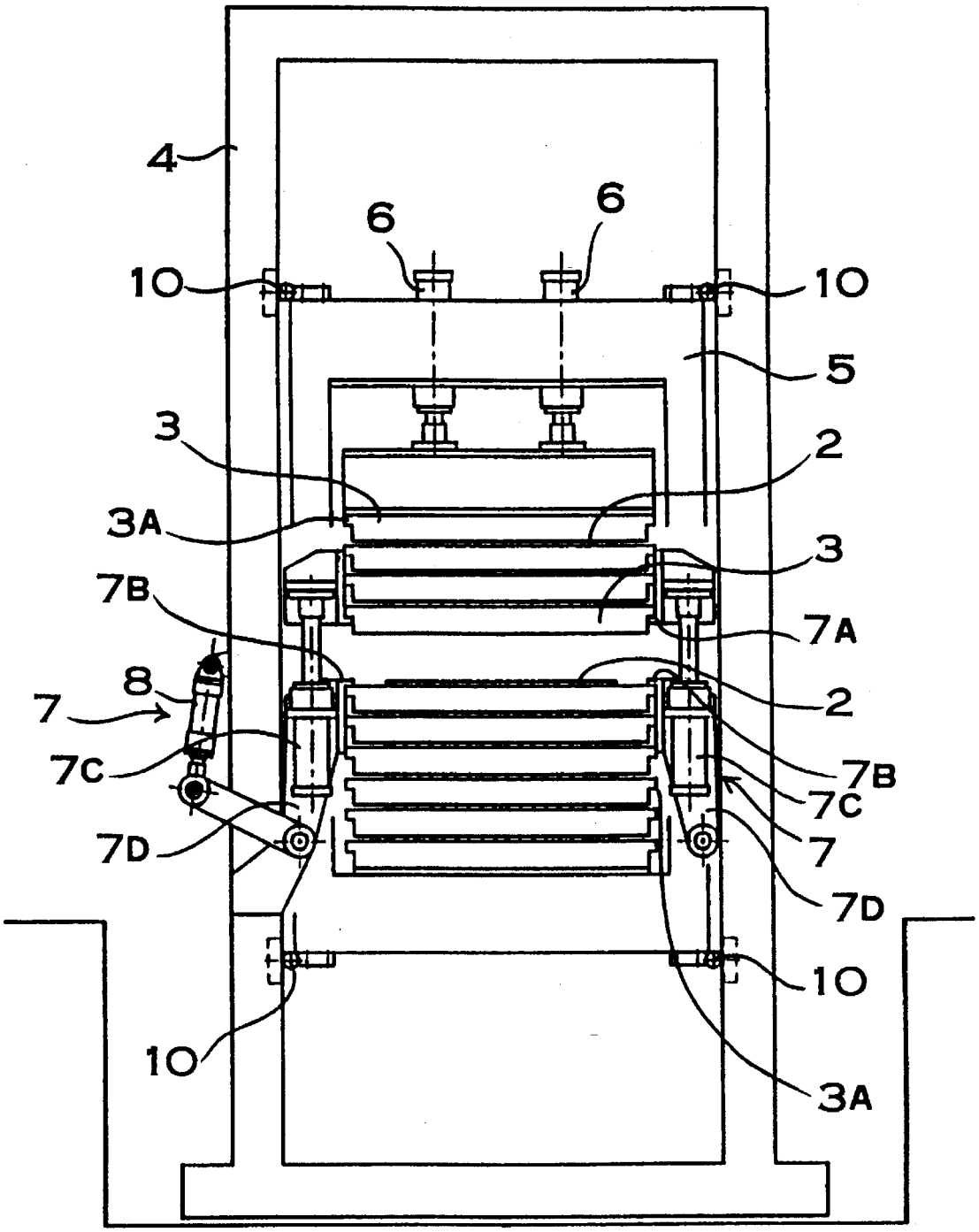
FIG. 3 is a side view of an embodiment of an apparatus used for carrying out a method for drying wood plates using hot plates according to the present invention.
Figure 4:
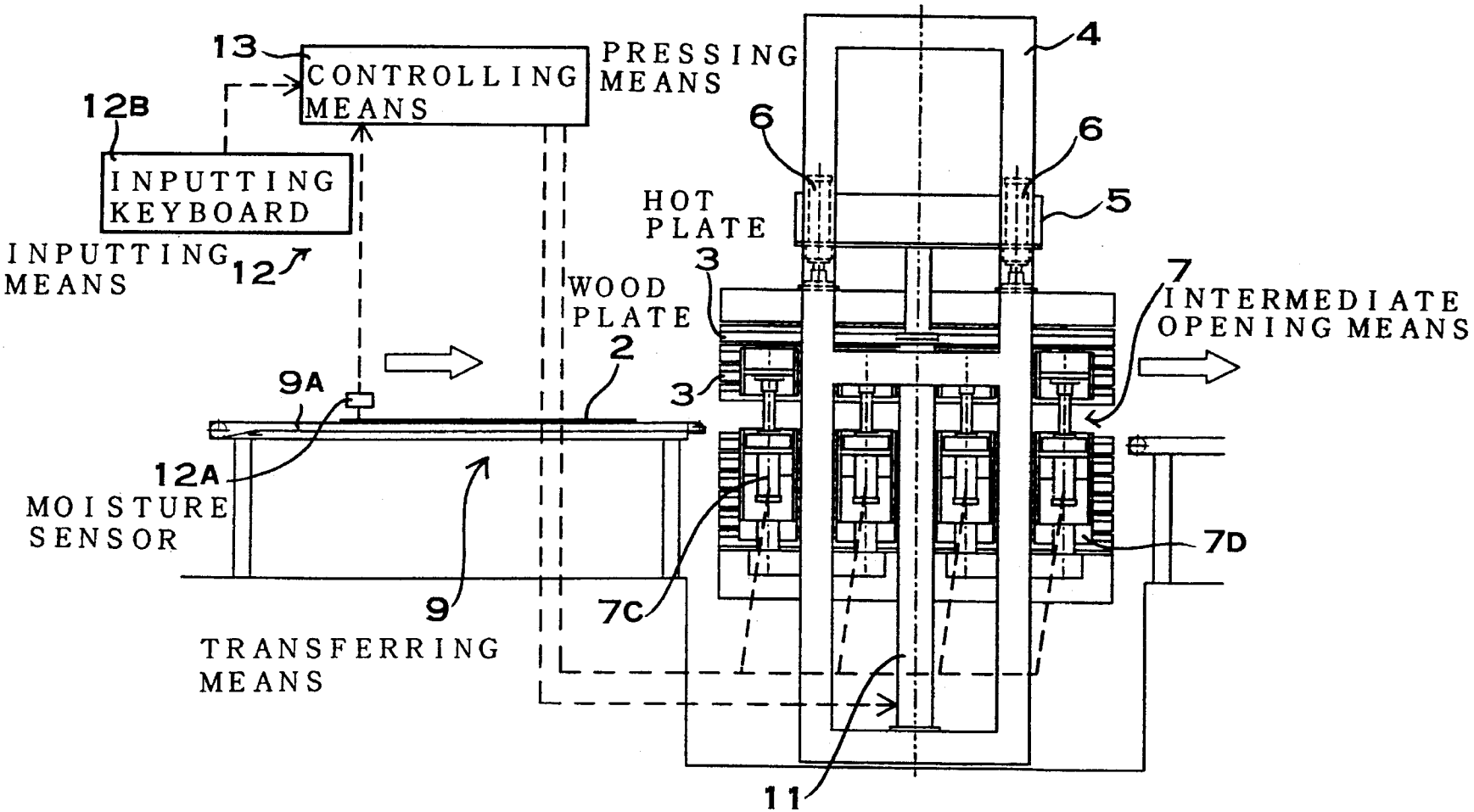
FIG. 4 is a front view of an apparatus of FIG. 3.

An embodiment of an apparatus for drying wood plates using hot plates according to the invention is shown in FIGS. 3 and 4, wherein the wood plates or panels 2 are shown as veneers. However, instead of veneers, other wood plates 2 similarly can be dried by this apparatus.

The apparatus shown in FIGS. 3 and 4 comprises a frame 4, a movable frame 5 vertically movably mounted on the frame 4, and pressing means 6 for pressing hot plates 3. The pressing means 6 is fixed to the movable frame 5. A plurality of hot plates 3 are stacked on one another and are vertically movably connected to the movable frame 5 in a multistep manner. An intermediate opening and closing device or means 7 opens a space between any pair of adjacent hot plates 3, to enable transfer of a wood plate into such space between such pair of hot plates 3 and discharge of a dried wood plate 2 therefrom. A transferring means 9 transfers the wood plate 2 into the space between the hot plates 3. An input means 12 inputs drying data of the wood plate 2 to be transferred to the space between the hot plates 3 into a control means 13 for calculating, based on a signal from the input means 12, a pressing time for which the hot plates 3 hold the wood plate 2, and for controlling operation of the intermediate opening means 7 dependent on the calculated pressing time.

The movable frame 5 has a shape such that a plurality of hot plates 3 can be provided in multistep manner inside the frame 4. According to the apparatus of the present invention, unlike a conventional apparatus for drying wood plates using hot plates wherein all of the hot plates 3 layered in multistep manner are opened at the same time, only a part of the hot plates 3 are opened to enable insertion or discharge a wood plate 2. Therefore, the height of the movable frame 5 can be reduced to a height only necessary for one space between only two hot plates 3 to be opened. As shown in FIG. 3, running wheels 10 are fixed to upper and lower portions of the moving frame 5. As the running wheels 10 move rectilinearly along the inside of the frame 4, the movable frame 5 moves upwardly and downwardly. The transferring means 9 is immovable, and thus the movable frame 5 is moved upwardly and downwardly so that a wood plate 2 can be transferred into or discharged from the space between any pair of two adjacent hot plates by the transferring means 9. The movable frame 5 is connected to a vertical moving means 11 fixed to the frame 4, so that the movable means 5 can be moved upwardly and downwardly. The vertical moving means 11 is an oil pressure cylinder.

The pressing means 6 comprises main cylinders fixed to upper portions of the movable frame 5 so as to press downwardly hot plates 3. In FIGS. 3 and 4, the pressing means 6 comprises four main cylinders vertically fixed to the upper portions of the movable frame 5. Each main cylinder has a pressing plate fixed to a lower end portion thereof. The main cylinders press the uppermost hot plate 3 with a predetermined pressure through the pressing plates. The main cylinders are designed to press hot plates 3 constantly with a predetermined pressure, even if the hot plates 3 move upwardly and downwardly, e.g. as a space between two hot plates 3 is opened and a wood plate 2 is inserted into the space therebetween. Such new wood plate then is pressed between the two hot plates 3 when they subsequently are brought together.

The hot plates 3 are connected through guide means (not shown) to the movable frame 5 so as to move upwardly and downwardly. A plurality of hot plates 3 are provided, and a number of wood plates 2 can be dried at the same time. The hot plates 3 are heated with steam and heat dry wood plates 2. A steam passage is located inside each hot plate 3, and heated steam is passed through this passage to heat the hot plate 3. A wood plate 2 is held and dried between the two adjacent heated hot plates 3. As shown in FIG. 3, elongated projections 3A are provided at opposite ends of each hot plate 3. By such projections, a space between one pair of the hot plates 3 can be opened to enable a discharge therefrom of a dried wood plate and insertion therein of a new undried wood plate. At such time, all other hot plates still press the other wood plates 2 through the pressing means 6. By pressing elongated projections 3A by the intermediate opening means 7, the one pair of hot plates is opened.

Each intermediate opening means 7 comprises an opening and closing cylinder 7C, a moving support 7D and a moving cylinder 8. The opening and closing cylinder 7C is fixed to the moving support 7D, and the moving support 7D is pivotally connected through a pine to the frame 4. The intermediate opening means pushes up a specified hot plate 3 and thereby opens the space between such hot plate and the immediately adjacent lower hot plate 3. For this purpose, an opening hook 7A for pushing up a hot plate 3 is fixed to the end of a rod of the opening and closing cylinder 7C. A pushing hook 7B for pushing down a hot plate is fixed to the moving support 7D. While the pushing hooks 7B are pushing down a hot plate 3, the opening hooks 7A push up the hot plate 3 thereabove, and the space between such two adjacent specified hot plates is opened.

When the movable frame 5 is vertically moved, the opening hook 7A and the pushing hook 7B are moved to positions where they do not hinder such movement. The moving cylinder 8 makes the moving support 7D pivot, and thereby moves the opening hook 7A and the pushing hook 7B to the positions where they do not hinder movement of the movable frame 5. The upper end of the moving cylinder 8 is fixed to the frame 4, while the lower end of the rod of the moving cylinder 8 is connected to the end of an arm fixed to the moving support 7D. When the rod of the moving cylinder 8 shown in FIG. 3 is extended, the moving support 7D pivots in a direction such that the opening hook 7A and the pushing hook 7B are moved to the positions not hindering movement of the movable frame 5. When the rod of the moving cylinder 8 is contracted and moved in the opposite direction, the opening hook 7A connected to the opening and closing cylinder 7C and the pushing hook 7B connected to the moving support 7D are moved to positions where they can catch the projections 3A of two specified adjacent hot plates 3, as shown in FIG. 3.

The transferring means 9 is of a so-called tray belt system, and comprises a thin belt conveyor 9A which is insertable into the opened space between the two hot plates 3, and a main part for moving the belt conveyor 9A forwardly and rearwardly. The main part of the transferring means 9 inserts the belt conveyor 9A with a new undried wood plate 2 mounted thereon into the space between the two hot plates 3 and thereby transfers such wood plate into such space. At this stage, a dried wood plate 2 already between the two hot plates 3 is pushed by the head end of the belt conveyor 9A and is discharged thereby. After that, the belt conveyor 9A is moved rearwardly and is withdrawn from the space, while the undried wood plate 2 is transferred from the belt conveyor 9A onto the lower of the two hot plates. When the speed of rearward movement of the belt conveyor 9A and the speed of the transfer of the wood plate 2 are the same, the wood plate 2 can be transferred onto the hot plate 3 without being displaced.

The input means 12 inputs drying data of the new undried wood plate 2 into the control means 13. In the apparatus shown in FIG. 3, the input means 12 comprises a moisture sensor 12A and an input keyboard 12B. The moisture sensor 12A detects the moisture content of wood plate 2 and inputs data representative thereof into the control means 13. In an apparatus for drying wood plates using hot plates in which the input means 12 comprises a moisture sensor 12A, drying data of the wood plate 2 is the moisture content thereof. The moisture sensor detects the moisture content of the wood plate to be inserted into the space between the two hot plates 3. Any type of sensor capable of detecting moisture content of a wood plate can be used. However, a preferable sensor detects the moisture content of the wood plate by contacting a pair of electrodes with the wood plate to measure the electric conductivity thereof and determines the moisture content therefrom. By such moisture sensor, the moisture content of wood plate 2 can be detected simply and rapidly. Moisture sensor 12A also can detect the moisture content of wood plate 2 by measuring the weight of the wood plate, since the moisture content increases as the weight of the wood plate increases.

The input keyboard 12B has push button switches (not shown) for inputting drying data such as the material and the thickness of a wood plate 2. The drying data input through the inputting keyboard 12B are transmitted to the control means 13. Such a keyboard is not required in an apparatus in which wood plates of the same material and of the same thickness are inserted between hot plates.

Figure 6:
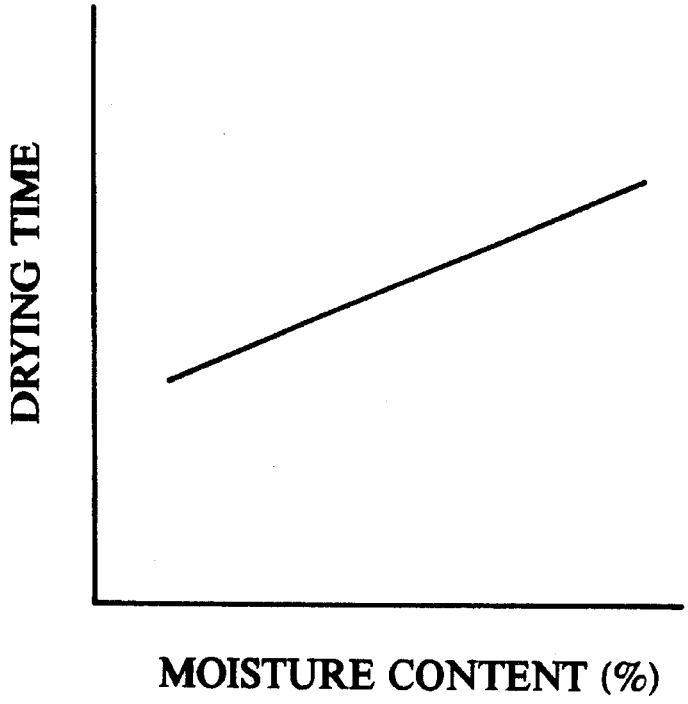
FIG. 6 is a graph showing the function of moisture content relative to drying time.
Figure 7:
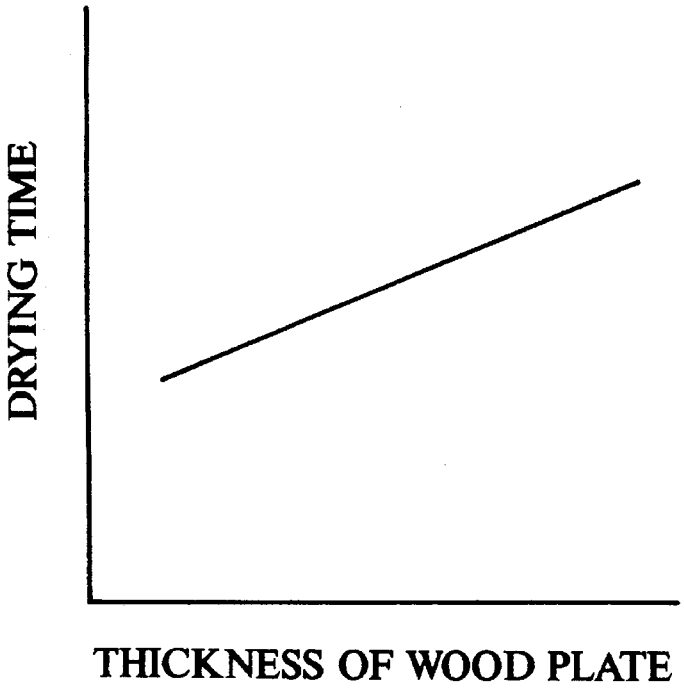
FIG. 7 is a graph showing the function of drying time relative to thickness of a veneer.

The control means 13 calculates the drying time required for the wood plate 2 based on the drying data transmitted from the moisture sensor and the input keyboard 12B. The moisture sensor 12A inputs the moisture content of the wood plate 2 into the control means 13. The control means 13 has a memory of functions of drying time relative to moisture content, for example, as shown in FIG. 6. By means of the control means 13, the apparatus is controlled to dry a wood plate of a higher moisture content for a longer drying time and to dry a wood plate of a lower moisture content rate for a shorter time, as shown in FIG. 6, so that each wood plate is dried to have the same moisture content when it is discharged from the hot plates 3. Data such as the material and the thickness of a wood plate 2 are input through the input keyboard 12B into the control means 13. The control means has a memory of functions of drying time relative to thickness of a wood plate, for example as shown in FIG. 7. By means of the control means, a thicker wood plate is dried for a longer drying time and a thinner wood plate is dried for a shorter drying time. Thereby, each wood plate is dried to have the same moisture content when it is discharged from the hot plates 3.

The control means 13 calculates the drying time of a wood plate 2 based on the drying data transmitted from the moisture sensor and the input keyboard 12B, and operates the apparatus to dry the wood plate 2 while it is pressed between the hot plates 3 for the calculated drying time and then to open such hot plates and to discharge the wood plate 2. In order to discharge the wood plate from hot plates 3 when the calculated drying time has passed, the control means 13 controls the vertically moving means 11, the intermediate opening means 7 and the transferring means 9. For discharging the wood plate 2 dried between the hot plates 3, the control means 13 controls the vertically moving means 11 so as to move the dried wood plate 2 to a position in line with the height of the transferring means 9. Thereafter, by controlling the intermediate opening means 7, the hot plates 3 pressing therebetween the wood plate 2 are opened. Then, the transferring means is inserted between the opened hot plates 3, whereby the dried wood plate 2 is discharged therefrom and a new undried wood plate 2 is inserted into the space between the opened hot plates 3. Thereafter, by controlling the intermediate opening means 7, the hot plates 3 are closed and the new wood plate 2 is pressed and dried between the hot plates 3.

The above mentioned apparatus dries wood plates 2 in the following steps, including initially inserting wood plates into respective spaces between all of the hot plates.

1. At the beginning, no wood plates are held between any of the hot plates.
2. By protruding or extending the rod of the moving cylinder 8, the intermediate opening means 7 is moved to the position not hindering up and down movement of the movable frame.
3. The movable frame is moved to its uppermost position.
4. By retracting the rod of the moving cylinder 8, the opening hook 7A and the pushing hook 7B are moved to positions engageable with the elongated projection 3A of the two lowermost hot plates. In this step, the pressing means 6 is pressing the hot plates 3.
5. The rod of opening and closing cylinder 7C of the intermediate opening means 7 is extended, thereby pushing up the second lowermost hot plate 3. The lowermost hot plate 3 is pushed by the pushing hook 7B and therefore is not moved up. As a result, a space between the lowermost and the second lowermost plates 3 is opened.
6. The moisture content of the wood plate 2 to be inserted into such space is detected by the moisture sensor 12A.

Further, the thickness of the wood plate 2 is input through the input keyboard 12B.

7. The control means 13 calculates the drying time of the wood plate 2 based on the input moisture content and the thickness of the wood plate 2.
8. The transferring means 9 is controlled by the control means 13 so that the wood plate 2 is inserted into the space between the hot plates 3 by the belt conveyor 9A. The belt conveyor 9A then is retracted so that the inserted wood plate 2 is not moved back from hot plates 3. In such manner, the wood plate 2 is inserted into the space between the opened hot plates 3.
9. By retracting the rod of the opening and closing cylinder 7C of the intermediate opening means 7, the lowermost and the second lowermost hot plates again are put into the pressed state.
10. The intermediate opening means 7 is controlled by the control means so that the opening and closing hook 7A and the pushing hook 7B are moved to the positions not hindering movement of the movable frame 5. The movable frame 5 then is moved downwardly by a height corresponding to a step of one hot plate 3.
11. By pivoting the moving support 7D, the opening and closing hook 7A and the pushing hook 7B are moved to the positions engageable with the elongated projections of the hot plates 3.
12. The intermediate opening means 7 is controlled by the control means 13 so that the rod of the opening and closing cylinder 7C is extended. Thereby, the space between the second lowermost hot plate 3 and the third lowermost plate 3 is opened, and a new undried wood plate 2 is transferred onto the second lowermost hot plate 3. Before the transfer of such wood plate 2, the moisture content thereof is detected by the moisture sensor 12A and the thickness thereof is input through the input keyboard 12B into the control means 13. However, if the thickness of the wood plate 2 is the same as that of the previous wood plate 2, the thickness is not put through the keyboard. When the thickness is not input, the control means 13 judges that the thickness of this wood plate 2 is the same as that of the previous wood plate 2 and calculates the drying time based on such data.

By repeating the above mentioned steps, wood plates are inserted into the spaces between all of the hot plates 3. The wood plates 2 inserted into the spaces between the hot plates 3 are discharged therefrom after the calculated drying times have passed. The control means 13 controls the vertically moving means 11, the intermediate opening means 7 and the transferring means 9, so that a wood plate 2 dried for the calculated drying time thereof is discharged. As a dried wood plate 2 is discharged, an undried wood plate 2 is inserted into the space between the hot plates 3 thereof.

When wood plates to be dried are of the same thickness and of the similar moisture content, the calculated drying time of the wood plates are similar. When the drying times of the wood plates are similar, the dried wood plates are discharged in the order of being inserted into the respective spaces between the hot plates 3. However, when the wood plates 2 to be dried are of different thicknesses or of much different moisture contents, the dried wood plates 2 are not discharged in the order of being inserted into the respective spaces between the hot plates 3. When the drying time of a wood plate 2 first inserted into a space is much longer than that of another wood plate 2 inserted secondly, then the dried wood plates 2 are discharged in reverse contrary order. The control means 13 controls the timing of opening the hot plates 3, or changes the order of discharging the wood plates 2 from the hot plates 3, so that each wood plate 2 can be dried by the hot plates 3 for its respective drying time calculated based on its drying data. Thereby, each dried wood plate can be dried to have the same moisture content.

The dried wood plate 2 is pushed by the head end of the belt conveyor 9A of the transferring means 9 and is discharged from the space between the hot plates 3 opened by the intermediate opening means 7. After the dried wood plate 2 is discharged, an undried wood plate mounted on the belt conveyor 9A is inserted into the space between the hot plates 3. For discharging the dried wood plate 2, the rod of the opening and closing cylinder 7C is extended so that the upper hot plate 3 is pushed up by the opening hook 7A and the lower hot plate 3 is pushed down by the pushing hook 7B, whereby the space between the hot plates 3 is widened and opened. In this condition, the next lower hot plate 3 adjacent to the pushed open two hot plates 3 is pushed down by the pushing hook 7B, while the next upper hot plate adjacent to the pushed open hot plates 3 is pushed down by the pressing means 6 and up by the opening hook 7A. Therefore, hot plates 3 other than the two opened hot plates 3 are maintained in a pressed state.

In the above mentioned embodiment of an apparatus for drying wood plates using hot plates according to the present invention, both of the moisture content and the thickness of each wood plate are used as the drying data, and each wood plate is dried for a drying time calculated on the drying data, so that each dried wood plate has a uniform moisture content. By such an apparatus of the present invention, wood plates of different thicknesses and different moisture contents can be dried to have a uniform moisture content. For example, by such an apparatus, veneers of 3 mm thickness and veneers of 6 mm thickness can be dried together. In the conventional apparatus, when the wood plates to be dried are of different thicknesses, the pressing condition and the like of the hot plates must be changed, and therefore wood plates of different thicknesses cannot be dried together. Further, much time and labor is required for changing the drying conditions according to different thicknesses of wood plates to be dried, and operation efficiency of the apparatus is remarkably lowered. However, in the apparatus of the present invention, by inputting the thickness of each veneer to be dried as one of the drying data, each veneer can be dried under optimum conditions. Therefore, according to the present invention, veneers of different thicknesses can be dried to have a uniform moisture contact, without the need for operations such as changing the drying conditions with each veneer.

In FIGS. 3 and 4, the sixth and seventh lowermost hot plates 3 are opened, and a wood plate 2 is inserted into the space between the opened hot plates 3 and discharged therefrom. the spaces between the hot plates 3 other than the sixth and seventh lowermost hot plates 3 are closed, and wood plates 2 are pressed between the closed hot plates. The hot plates can be opened in order from the uppermost from the lowermost, or in any other predetermined order, and a wood plate 2 be discharged and another wood plate 2 be inserted.

Figure 5:
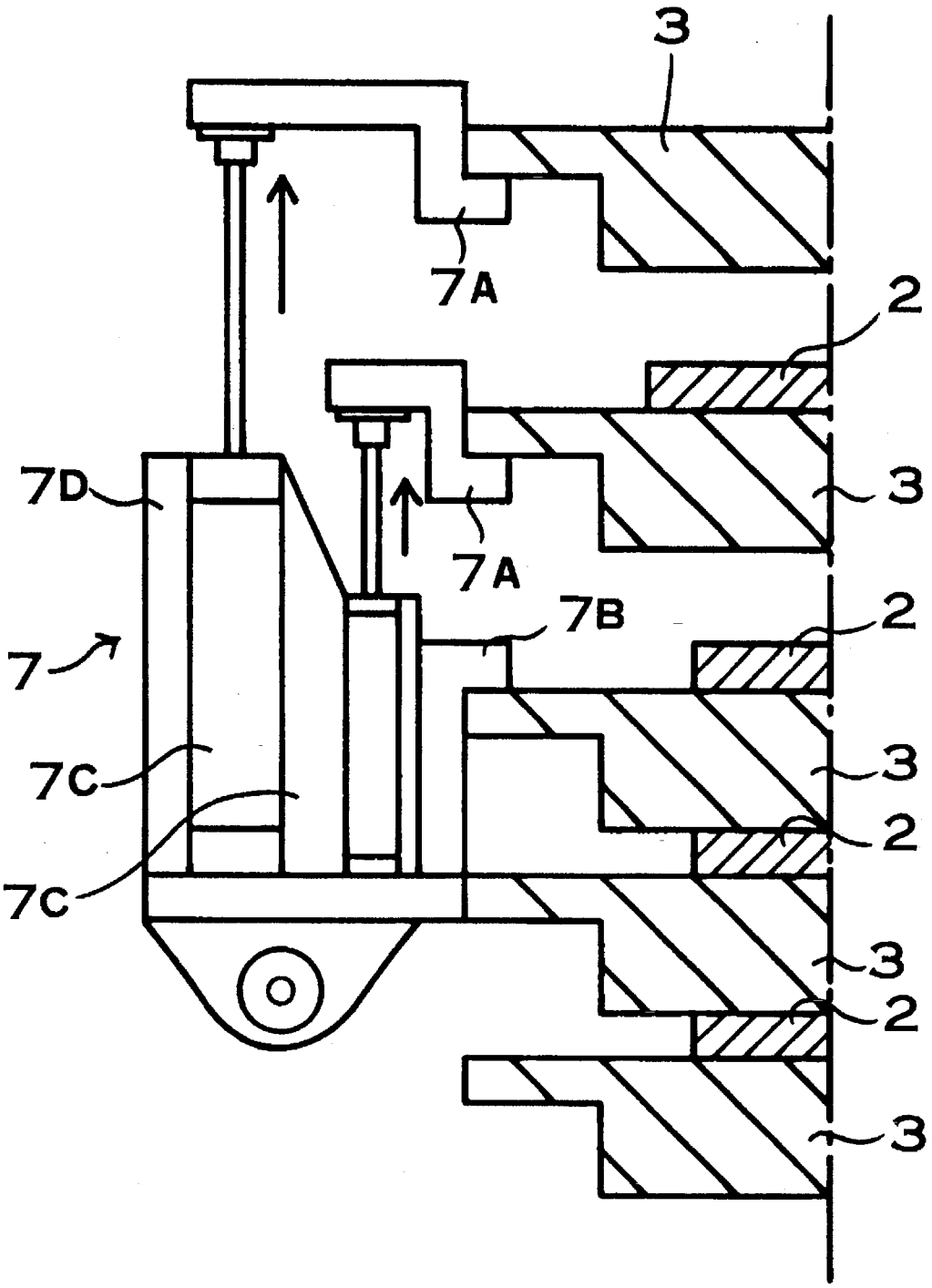
FIG. 5 is a partial front view of a main part of another embodiment of the apparatus according to the present invention.

In FIGS. 3 and 4, one space between two hot plates is opened and a wood plate is inserted therein. However, according to the method of the present invention, two or more steps of hot plates can be opened and two or more wood plates can be inserted and discharged at the same time, as shown in FIG. 5. However, all of the hot plates of the apparatus are not opened at the same time. When a portion of the hot plates are opened, the other hot plates are closed and wood plates are dried in a pressed state between the respective closed hot plates.

What is claimed is:

1. A method of drying wood plates, said method comprising:

inserting each of a plurality of undried wood plates between a respective pair of adjacent hot plates of a stacked plurality of hot plates;

applying pressure to all of said stacked hot plates and thereby pressing said wood plates between respective pairs of adjacent said hot plates, while applying heat to said wood plates from said hot plates, thereby drying said wood plates;

periodically separating said hot plates of plural said pairs of adjacent said hot plates, said periodically separating comprising separating at a given time said hot plates of a portion only of said pairs of adjacent said hot plates and thereby opening a space between each thus separated pair of adjacent said hot plates, while maintaining application of said pressure to said hot plates of remaining unseparated said pairs of adjacent said hot plates and said wood plates pressed therebetween;

discharging the dried said wood plate from said space between each said separated pair of adjacent said hot plates and supplying a new undried wood plate into said space; and closing each said space such that said pair of adjacent said hot plates thereof no longer are separated and such that said pressure thereafter is applied thereto and to said new undried wood plate, whereafter said new undried wood plate is pressed and dried.

2. A method as claimed in claim 1, wherein said separating comprises separating said hot plates of only one said pair of adjacent said hot plates at a time.

3. A method as claimed in claim 1, wherein said separating comprises simultaneously separating said hot plates of at least two said pairs of adjacent said hot plates.

4. A method as claimed in claim 1, wherein said separating comprises pushing said hot plates of the respective said pair of said hot plates in directions away from each other.

5. A method as claimed in claim 1, further comprising inputting drying data relating to each said undried wood plate to a control and thereat determining a drying time for said undried wood plate based on said drying data, and controlling said separating and said discharging as a function of said determined drying time.

6. A method as claimed in claim 5, wherein said inputting comprises sensing the moisture content of said undried wood plate and supplying a signal representative thereof to said control.

7. A method as claimed in claim 5, wherein said inputting comprises supplying data relating to material and thickness of said undried wood plate to said control.

8. An apparatus for drying wood plates, said apparatus comprising:

a stacked plurality of hot plates adapted to receive therebetween and to apply heat to a plurality of wood plates when each such wood plate is positioned between a respective pair of adjacent said hot plates;

an opening and closing device operable to selectively separate said hot plates of plural pairs of adjacent said hot plates, with said hot plates of a portion only of said pairs of adjacent said hot plates being separated at a given time, and thereby open a space between each thus separated pair of adjacent said hot plates and to selectively close each said space such that said pair of adjacent said hot plates thereof no longer is separated;

a pressing device to apply pressure to said hot plates of all of said pairs of adjacent said hot plates except for each said separated pair of adjacent said hot plates, such that the wood plates except for the wood plate between each said separated pair of adjacent said hot plates are pressed while being heated; and a transfer device to discharge a dried wood plate from said space between each said separated pair of adjacent said hot plates and to supply a new undried wood plate into said space, whereafter said opening and closing device closes said space and the new undried wood plate is heated by said respective pair of adjacent said hot plates and is pressed by said pressing device.

9. An apparatus as claimed in claim 8, wherein said opening and closing device is operable to separate said hot plates of only one said pair of adjacent said hot plates at a time.

10. An apparatus as claimed in claim 8, wherein said opening and closing device is operable to separate simultaneously said hot plates of at least two said pairs of adjacent said hot plates.

11. An apparatus as claimed in claim 8, wherein said opening and closing device is operable to push said hot plates of the respective said pair of hot plates in directions away from each other.

12. An apparatus as claimed in claim 8, further comprising a frame, said stacked plurality of hot plates being mounted on said frame.

13. An apparatus as claimed in claim 12, wherein said opening and closing device comprises a moving support pivoted to said frame, a moving cylinder mounted on said frame and operable to pivot said moving support to an operable position for achieving separation of a selected said pair of adjacent said hot plates, and an opening and closing cylinder connected to said moving support and operable, when said moving support is in said operable position thereof, to separate said selected pair of adjacent said hot plates.

14. An apparatus as claimed in claim 13, further comprising an opening hook fixed to a free end of a rod of said opening and closing cylinder to push a first said hot plate of said selected pair away from a second said hot plate thereof, and a pushing hook fixed to said moving support to push said second hot plate away from said first hot plate.

15. An apparatus as claimed in claim 13, wherein a first end of said moving cylinder is mounted on said frame, and a second end of said moving cylinder is connected to said moving support.

16. An apparatus as claimed in claim 12, further comprising a movable frame mounted on said frame for movement in opposite directions relative thereto, said stacked plurality of hot plates being supported on said movable frame.

17. An apparatus as claimed in claim 8, further comprising an input device to input drying data relating to each undried wood plate, and a control device operably connected to said input device to receive said drying data therefrom and to determine a drying time for the undried wood plate based on said drying data and operably connected to said opening and closing device and to said transfer device to control operation thereof as a function of said drying time.

18. An apparatus as claimed in claim 17, wherein said input device comprises a moisture sensor to determine the moisture content of the undried wood plate and to supply a signal representative thereof to said control device.

19. An apparatus as claimed in claim 18, wherein said moisture sensor comprises a pair of electrodes to be contacted with the undried wood plate to measure electrical conductivity thereof.

20. An apparatus as claimed in claim 17, wherein said input device comprises a keyboard connected to said control device and in which may be entered said drying data.

* * * * *